US008240791B2

(12) United States Patent
Benz et al.

(10) Patent No.: US 8,240,791 B2
(45) Date of Patent: Aug. 14, 2012

(54) INNER CONTAINER FOR A REFRIGERATING DEVICE

(75) Inventors: Thomas Benz, Haar (DE); Alexander Görz, Aalen (DE); Hans-Philipp Reitz, Giengen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 640 days.

(21) Appl. No.: 11/919,200

(22) PCT Filed: Apr. 6, 2006

(86) PCT No.: PCT/EP2006/061379

§ 371 (c)(1), (2), (4) Date: Oct. 28, 2009

(87) PCT Pub. No.: WO2006/120097

PCT Pub. Date: Nov. 16, 2006

(65) Prior Publication Data

US 2010/0031694 A1 Feb. 11, 2010

(30) Foreign Application Priority Data

May 10, 2005 (DE) ..... 10 2005 021 566

(51) Int. Cl.
*A47B 96/04* (2006.01)
*F25D 25/00* (2006.01)
*A47F 5/08* (2006.01)

(52) U.S. Cl. ..... 312/405; 312/401; 62/465; 211/90.02; 211/153

(58) Field of Classification Search ..... 312/408, 312/404, 400, 401, 406, 406.2, 351; 108/108; 62/329, 465; 211/26, 182; 52/300, 301
See application file for complete search history.

(56) References Cited

U.S. PATENT DOCUMENTS

| | | | | |
|---|---|---|---|---|
| 2,255,744 | A * | 9/1941 | Loeb et al. | 312/234 |
| 2,997,353 | A * | 8/1961 | Horvay | 312/406.2 |
| 3,622,215 | A * | 11/1971 | Roberts | 312/406.2 |
| 3,707,317 | A * | 12/1972 | Dawley et al. | 312/408 |
| 3,858,409 | A * | 1/1975 | Besing | 62/285 |
| 4,006,947 | A | 2/1977 | Haag et al. | |
| 4,296,983 | A * | 10/1981 | Rogers et al. | 312/263 |
| 4,320,935 | A * | 3/1982 | Nagelkirk | 312/350 |
| 5,004,302 | A | 4/1991 | Stocking et al. | |
| 5,199,778 | A * | 4/1993 | Aoki et al. | 312/408 |
| 5,361,599 | A | 11/1994 | Dasher | |
| 5,692,817 | A * | 12/1997 | Jun et al. | 312/408 |

(Continued)

FOREIGN PATENT DOCUMENTS

JP 6-300429 10/1994

*Primary Examiner* — Darnell Jayne
*Assistant Examiner* — Andrew Roersma
(74) *Attorney, Agent, or Firm* — James E. Howard; Andre Pallapies

(57) ABSTRACT

A container for forming an interior space within a refrigerating device that can be accessed via a door opening of the refrigerating device including a plurality of blanks forming a plurality of walls, a cooled goods support base, and a support rail such that the height of the cooled goods support is adjustably settable. A joint is formed between a blank forming the first side wall and a blank forming the rear wall, and the joint is at least partly concealed behind the support rail relative to a view into the refrigerating device through the door opening.

11 Claims, 3 Drawing Sheets

U.S. PATENT DOCUMENTS 5,720,185 A * 2/1998 Lee ..... 62/408
5,908,229 A * 6/1999 Wetherholt et al. ..... 312/406.2
5,971,511 A * 10/1999 Diebel et al. ..... 312/265.3
5,992,960 A * 11/1999 Wolanin ..... 312/407
6,233,964 B1 * 5/2001 Ethington et al. ..... 62/344
6,350,002 B1 * 2/2002 Takaoka et al. ..... 312/407
6,851,775 B2 * 2/2005 Kaiser ..... 312/404
2003/0173878 A1 * 9/2003 Youngs et al. ..... 312/257.1
2004/0080249 A1 * 4/2004 Harvie, III ..... 312/351
2004/0104654 A1 * 6/2004 Lee et al. ..... 312/401
2004/0149181 A1 * 8/2004 Bienick ..... 108/108
2005/0006998 A1 * 1/2005 Kaczmarek ..... 312/408

* cited by examiner

INNER CONTAINER FOR A REFRIGERATING DEVICE

The present invention relates to an inner container for a refrigerating device having walls assembled from a plurality of blanks made of a flat material.

The inner container is in most refrigerating devices conventionally formed as a single piece from a plastic blank by deep drawing. The advantage of that technique is that an inner container is obtained that is largely free from sharp corners in which hard-to-remove dirt can collect.

Refrigerating devices having a deep-drawn inner container of said type are known in the case of which mounted inside the inner container are vertical support rails on which compartment bottoms can be mounted at different heights selected by the user.

Refrigerating devices in which the inner container is made of metal, in particular stainless sheet steel, have of late enjoyed growing popularity. An inner container of said type is not suited for single-piece production; it is instead generally assembled from three blanks forming respectively the cover, bottom, and three walls of the inner container, or from five blanks forming respectively the cover, bottom, rear wall, and in each case a side wall.

A disadvantage of inner containers assembled from a plurality of flat-material blanks is that where their walls or the material blanks forming the walls abut, said containers have in general narrow furrows in which hard-to-remove dirt can collect. The width and depth of said furrows depend on the radius of curvature with which edge areas of the blanks that are mutually opposite and require to be mutually secured are folded from the blanks' bordering surfaces.

An object of the invention is to provide an inner container for a refrigerating device that has support rails and walls assembled from a plurality of flat-material blanks and will be as easy to clean as an analogously shaped single-piece deep-drawn inner container.

The object is achieved by concealing a joint between a blank forming a side wall and a blank forming a rear wall—and hence also concealing the furrow perforce existing on the joint—behind a support rail, secured to the inner container, for a compartment bottom. The furrow will hence not be visible to the user; it will furthermore be protected by the support rail against soiling and so require no cleaning whatever.

The blank forming the side wall and the blank forming the rear wall preferably form the boundary of a channel in the inner container in which channel the support rail is accommodated.

A first web forming a first side of the channel and a second web forming a bottom of the channel is therein particularly preferably embodied as being of a single piece with a first of said two blanks, and a second channel side opposite the first side and a third web parallel to the rear wall are folded on the respective other blank, and an edge area of the second web extending beyond the width of the channel is secured to the third web in any suitable manner. Being oriented parallel to the rear wall, the third web and the second web's edge area will not form a thermal bridge to the outside across the insulating layer surrounding the inner container in the finished refrigerating device.

Said first blank is preferably the blank forming the side wall and the other is the blank forming the rear wall.

The second web's edge area and the third web can be joined in any suitable manner, for example by means of rivets, screws, clamps, bead sealing, clinch joining, pasting, or welding.

Additional support rails can be inserted into the blank forming the rear wall, preferably in a roughly central position, to be able to mutually independently suspend compartment bottoms from the support rails at different heights in a right-hand or left-hand area of the rear wall.

Said additional support rails are inserted preferably into the blank forming the rear wall; specifically they are preferably held in place in a window, backed by a U profile, in the blank forming the rear wall.

The windows are preferably not simply cut from the blank forming the rear wall; webs having alternating projections and recesses along their edge are instead offset on the window's longitudinal edges. The web's projecting edge sections can reach through the slots in the U profile to anchor it to the blank forming the rear wall.

The ends of the support rails are preferably each sealed by means of a cap to prevent the ingress of insulating material into the inner container's interior at the rail ends.

Because the cap is applied to the exterior side of the blank forming the rear wall, locking of the support rails in the blank forming the rear wall will be achieved at the same time.

If the support rail is located at a distance from a corner between the side wall and rear wall and an edge web bridging said distance is offset from the blank forming the side wall, then hard-to-clean furrows in the transitional area between the inner container's side wall and rear wall will be completely avoided.

Further features and advantages of the invention will emerge from the following description of exemplary embodiments with reference to the attached figures.

Figure 1:
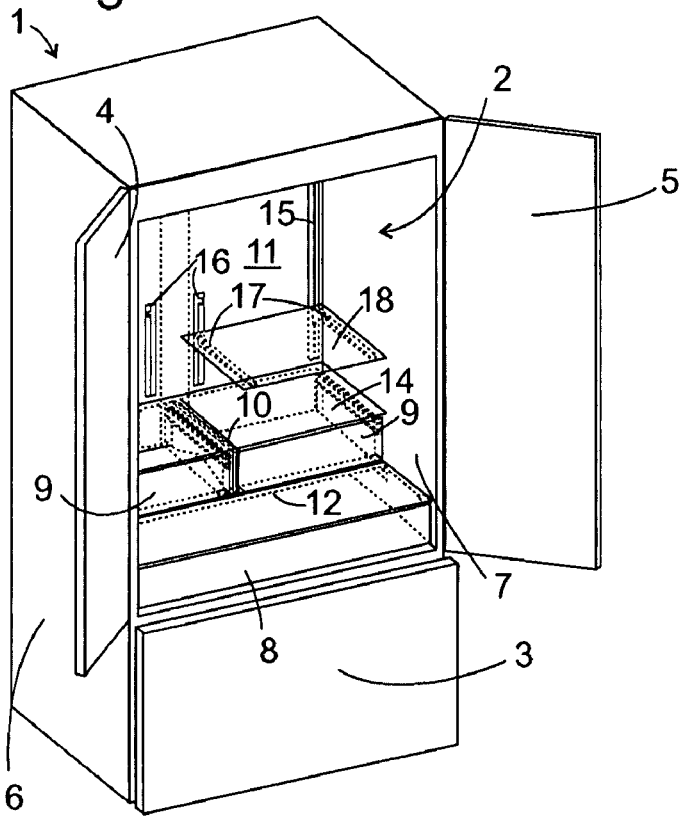
FIG. 1 is a perspective view of a refrigerating device fitted with an inventive inner container.

FIG. 1 shows as an example of an inventive refrigerating device a combination device whose carcass 1 surrounds, in a top area, a chilling space 2 and, in a bottom area, a freezing space. The freezing space is sealed by means of a door plate 3 that is not linked to the carcass 1 but is secured directly to a pull-out case accommodated within the freezing space and is pulled forward in parallel in order to pull out said case from the freezing space and access its contents.

The chilling space 2 can be sealed by means of two doors 4, 5 linked to the carcass's side walls 6, 7.

The bottom area of the chilling space 2 is filled with three pull-out cases each guided movably on telescopic rails, namely a bottom case 8, which extends across the entire width of the chilling space 2, and two cases 9 above it each of whose width matches that of a door 4 or, as the case may be, 5 so that they can be pulled out even if only one of the doors 4, 5 is open. Extending between the two top cases 9 is a plate-shaped longitudinal support 10 itself supported on the rear wall 11 of the chilling space 2 and, via a transverse support 12 extending below the front sides of the cases 9, on the side walls 6, 7. A plurality of support rails 15 or, as the case may be, 16 that each support a compartment bottom 18 via support arms 17 engaged with them are set into the rear wall 11 above a glass plate 14 covering the pull-out cases 9.

The support rails 15, each of which is set into the rear wall 11 at a small distance from the side walls 6,7, extend from the glass plate 14 to directly below the cover of the chilling space 2. The support rails 16 extend on both sides of a cold-air supply channel, which is concealed in the rear wall 11 and leads from a condenser chamber in the cover of the carcass 1 to the freezing space, in each case over a smaller height than the support rails 15. Compartment bottoms, such as the compartment bottom 18 shown in the figure as a single instance, can thus be suspended mutually independently at different heights to the right and left of a notional mid plane in the area of the chilling space 2 in which the support rails 15 and 16 extend jointly, while compartment bottoms that extend across the entire width of the chilling space 2 are used in the top area of the chilling space 2 not reached by the support rails 16.

Figure 2:
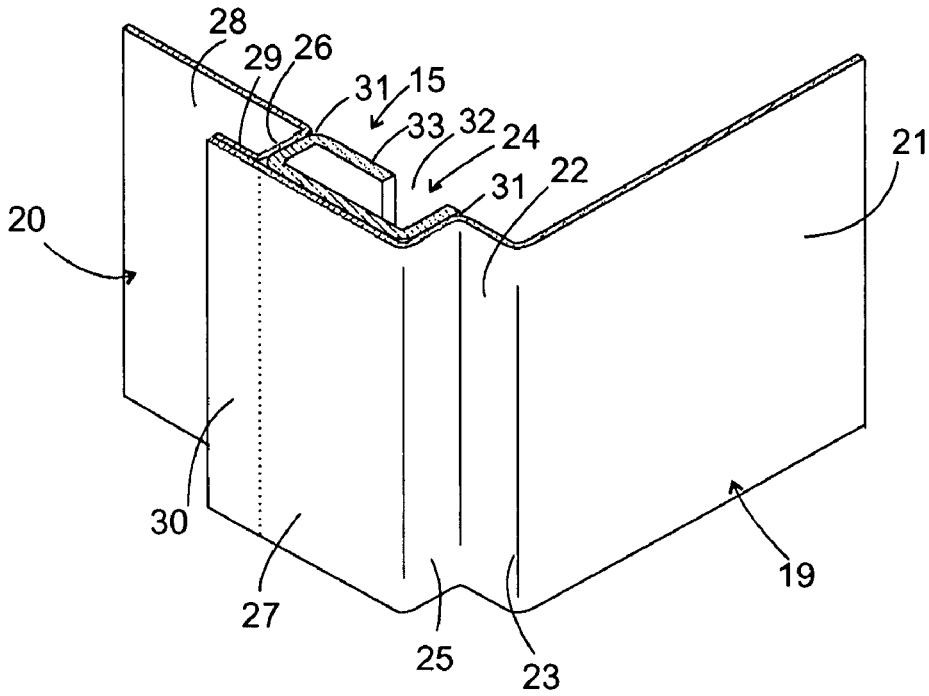
FIG. 2 is a perspective view of a section through a part of a corner area between the inventive inner container's side wall and rear wall.

FIG. 2 is a perspective view of a section of the inner container of the refrigerating device shown in FIG. 1. The inner container has been assembled from five cut-to-size stainless steel sheets, two of which substantially form one side wall each, one of which substantially forms a rear wall, and the remaining two of which form the inner container's top or bottom. FIG. 2 shows a piece of a metal sheet 19 substantially forming a side wall, referred to below for short also as side-wall sheet 19, a metal sheet substantially forming the rear wall, referred to also as rear-wall sheet 20, and one of the support rails 15. Folded at right angles from the main part 21 of the side-wall sheet 19 is a web 22 which lies in the plane of the rear wall 11 and bridges the distance between a corner 23, at which the rear wall 11 and side wall 19 meet, and a channel 24 accommodating the support rail 15. The channel 24 has two lateral sides 25, 26 facing each other and a bottom 27. The side 25 joins the web 22 as a single piece at right angles, and the bottom 27 joins the side 25 as a single piece and at right angles. The side 26 is folded at right angles from the main part 28 of the rear-wall sheet 20 and coheres as a single piece with a web 29 that is parallel to the main part 28 and extends towards the center of the rear wall 11 and which touches an edge area 30 of the bottom 27 and is secured thereto permanently and in a foam-tight manner by means of screws, rivets, welding, pasting, or suchlike.

Because no metal sheets of the inner container meet at the corner 23 between the rear wall and side wall, said corner can be embodied having an even curvature whose radius is sufficiently large to enable simple cleaning. Although furrows 31 resulting from folding of the metal sheets 19, 20 can occur on both sides of the support rail 15, said furrows, which would occur also in the case of a similarly shaped inner container formed as a single piece through deep drawing, will be easier to keep clean as they lie within a level surface.

As can be readily imagined with the aid of the figure, the bottom 27 of the channel 24 could also cohere as a single piece with the side 26 and have an outwardly projecting edge area analogous to the edge area 30 that is linked to a web outwardly offset from the side 25 analogous to the web 29. That variant is, though, somewhat less favorable from the viewpoint of heat insulation, especially if the web 29 and the edge area project outwardly beyond the plane of the inner-container side wall.

The support rail 15 has in the exemplary embodiment here under consideration a cross-section in the form of a rectangular hollow profile provided on a broad side with a slot 32. Detent fingers (not shown in figure) of the support arms 17 each reach through the slot 32 to be supported on detent projections concealed behind the from wall 33 of the support rail.

Figure 3:
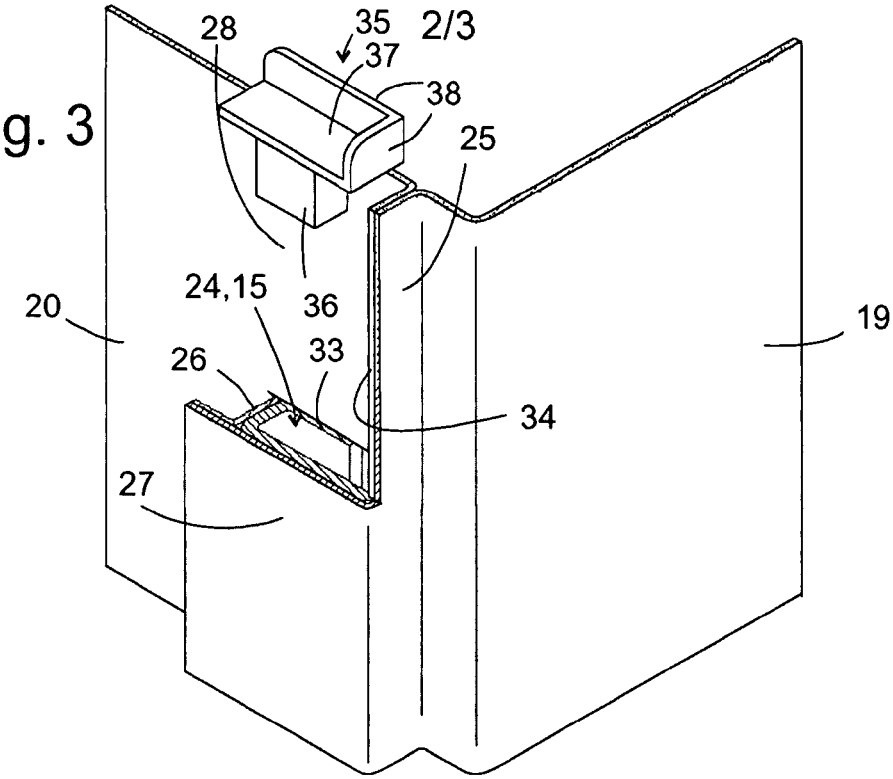
FIG. 3 is a perspective view, analogous to FIG. 2, in which can be seen the top end of a support rail.

FIG. 3 is a view onto a top corner of the inner container viewed from outside and with the cover omitted. The channel 24, along with the support rail 15 therein, does not extend right up to the height of the top edge of the side-wall sheet 19 and rear-wall sheet 20 but ends at a distance of a few centimeters therebelow. The web, forming the side 25 of the channel, of the side-wall sheet 19 has been extended beyond the end of the actual channel 24. The main part 28 of the rear-wall sheet 20 extends above the end of the channel 24 up to the web 25, and a web 34 touching the web 25 and secured thereto is folded from the main part 28.

A plastic closing element 35, shown in the figure separated from the support rail 15, includes a peg 36 that is provided for being inserted—concealed toward the inner container's interior by the front wall 33 of the support rail 15—in a form-fitting and frictionally engaged manner into the support rail 15. A head section of the closing element 35 includes a—in the figure—horizontal plate 37 that covers the top edges of the support rail 15, of the bottom 27, and of the side 26, and two vertical walls 38 applied in a form-fit and foam-tight manner against the exterior side of the main part 28 or, as the case may be, of the web 34 of the rear-wall sheet 20. The closing element 35 thus establishes both locking of the support rail 15 in its channel 24 and a foam-tight closure at its end.

The support rail 15 is at its bottom end (not shown) suitably sealed and locked by means of a closing element.

Figure 4:
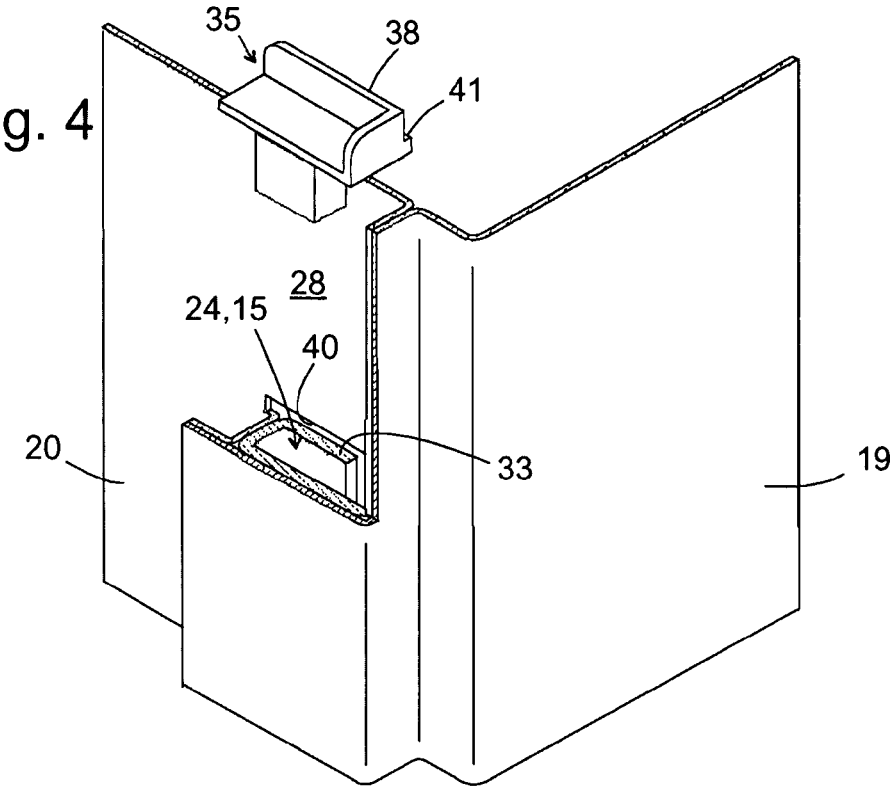
FIG. 4 is a view analogous to FIG. 3 according to a variant embodiment.

FIG. 4 is a view analogous to FIG. 3 according to a developed embodiment of the invention. It differs from what is shown in FIG. 3 through a narrow slot 40 formed in the rear wall between the top end of the support rail 15 and the main part 28 of the rear-wall sheet. The closing element 35 has on its wall 38 facing the main part 28 a projection 41 whose height and width are the same as those of the slot 40 and whose depth matches the thickness of the rear-wall sheet 20 so that the projection 41 will on the container's interior side in the figure facing away from the observer form a surface that is flush with the bordering rear-wall sheet 20 or, as the case may be, the front wall 33 of the support rail 15. The projection 41 causes the closing element 35 to latch securely in the slot 40 so that loss of the closing element 35 between assembling of the inner container and foaming of a refrigerating device's carcass in which the inner container is mounted will be precluded.

Figure 5:
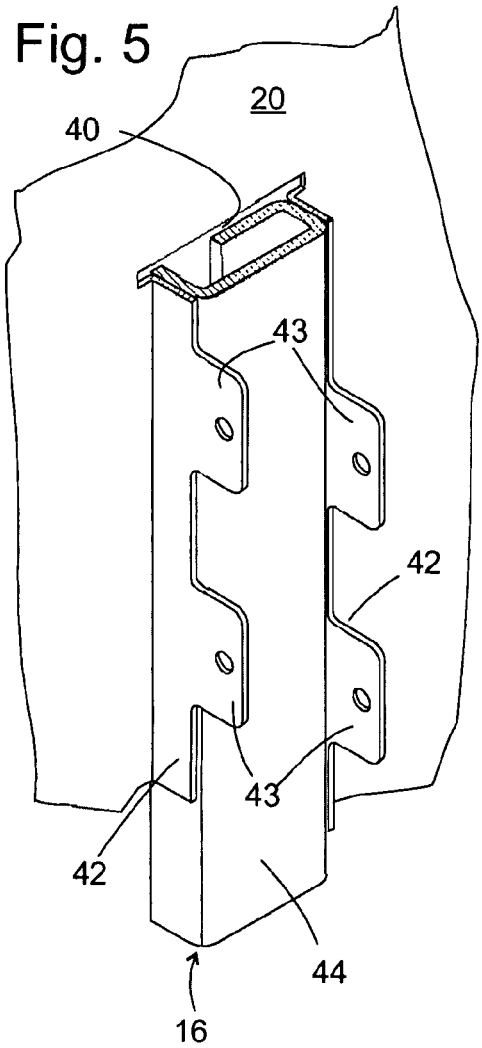
FIG. 5 shows a window in the inner container's rear wall, seen from said container's exterior side, having a support rail positioned in the window.
Figure 6:
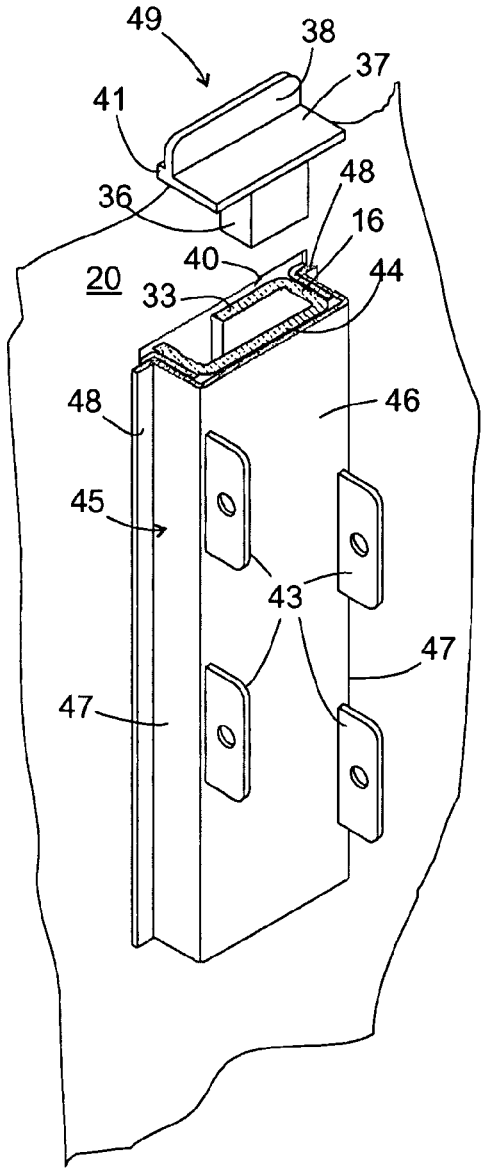
FIG. 6 shows the window and the support rail shown in FIG. 5 having a profiled sheet reverse-drawn thereover.

FIGS. 5 and 6 illustrate attaching of the support rails 16. For mounting these, a window each of whose vertical edges has alternating projecting and recessed sections is punched into the rear wall. By folding said edges towards the inner container's foam side the configuration shown in FIG. 5 is obtained having two vertical webs 42 that are folded at right angles from the rear-wall sheet 20, are applied against the narrow sides of the support rail 16, and extend between a top slot 40 and a corresponding bottom slot (not shown in the figure) exactly along the length of the support rail 16. Projecting sections 43 of the webs 42 extend beyond the rear wide side 44 of the support rail 16 facing the observer in the perspective of FIG. 5.

Shown in FIG. 6 is an ensuing assembly stage at which a U profile 45 formed likewise from metal sheeting has been reverse-drawn on the foam side over the support rail 16 and the webs 42. The dimensions of the U profile 45 are defined such that the front wall 33 of the support rail 16 will be flush with the rear-wall sheet's interior side when, as shown in the figure, the rear wide side 44 of the support rail touches the bottom 46 of the U profile.

The projecting sections 43 of the webs 42 extend through slots punched in alternating fashion into the bottom 46 adjacent to the limbs 47 of the U profile 45. Webs 48 each touching the rear-wall sheet 20 in a flush manner are folded on the edges of the limbs 47 facing the rear-wall sheet 20. By bending the projecting sections 43 apart the U profile 45 will be secured in the position shown and the webs 48 pressed securely against the rear-wall sheet 20.

A closing element 49, analogous to the closing element 35, having a peg 36 engaging into the support rail 16, a plate 37 covering the top edges of the support rail 16, of the U profile 45, and of the webs 42, a wall 38 supported on the foam side on the rear-wall sheet 20, and a projection 41 filling the slot 40 serves to lock the support rail 16 on the rear-wall sheet 20.

The invention claimed is:

1. A container for forming within a refrigerating device an interior space that can be accessed via a door opening of the refrigerating device, the container comprising:

a.) a plurality of blanks forming a plurality of walls, the walls delimiting an interior space and including a first interior side wall formed from at least one blank and an interior rear wall formed from at least one blank, wherein the blank forming the side wall and the blank forming the rear wall together form a channel wherein one of the at least one blanks forming the first side wall is formed with a first web forming a first side of the channel and a second web forming a bottom of the channel, and one of the at least one blanks forming the rear wall is formed with a third web opposite the first web and a fourth web that is parallel to the rear wall, wherein the second web has an edge area that extends beyond the width of the channel and is linked to the fourth web;

b.) a cooled goods support base on which cooled goods received within the interior space are supported;

c.) at least one support rail disposed within the channel, the support rail having locations thereon at which the cooled goods support base can be adjustably secured to the support rail such that the height of the cooled goods support within the interior space is adjustably settable and d.) a joint between the first side wall and the rear wall, the joint being at least partly concealed behind the support rail relative to a view into the container.

2. The container as claimed in claim 1, wherein a respective blank forms the first side wall and a respective blank forms the rear wall.

3. The container as claimed in claim 1, wherein a portion of the respective blank forming the first side wall extends longitudinally beyond the channel and the portion extending beyond the channel is linked to a folded edge of the blank forming the rear wall.

4. The container as claimed in claim 1 and further comprising additional support rails inserted into the blank forming the rear wall.

5. The container as claimed in claim 4, wherein the additional support rails are held in place in a window, backed by a U profile, in the blank forming the rear wall.

6. The container as claimed in claim 5, wherein the blanks are formed of webs having alternating projections and recesses along edges thereof that are offset on longitudinal edges of the window.

7. The container as claimed in claim 6, wherein projecting edge sections of the webs reach through slots of the U profile.

8. The container as claimed in claim 1 and further comprising caps that seal ends of the support rail.

9. The container as claimed in claim 8, wherein each cap has a detent projection reaching into the rear wall.

10. The container as claimed in claim 8, wherein each cap is mounted to an exterior side of the blank forming the rear wall.

11. The container as claimed in claim 1, wherein the support rail is located at a spacing from a corner between the first side wall and rear wall and an edge web bridging the spacing is offset from the blank forming the side wall.

* * * * *